United States Patent [19]

Riddle

[11] Patent Number: 4,668,122

[45] Date of Patent: May 26, 1987

[54] TWO BOLT TAPER CLEAT

[75] Inventor: Charles F. Riddle, Brookfield, Wis.

[73] Assignee: Rexworks Inc., Milwaukee, Wis.

[21] Appl. No.: 799,819

[22] Filed: Nov. 20, 1985

[51] Int. Cl.[4] ..... E01C 19/23

[52] U.S. Cl. ..... 404/121; 301/44 R; 172/122; 172/554

[58] Field of Search ..... 404/121, 124; 301/43, 301/44 R, 44 T, 44 A, 44 B; 172/122, 540, 554; 37/141 R, 141 T, 142 R; 299/91; 403/361, 362

[56] References Cited

U.S. PATENT DOCUMENTS

| | | | |
|---|---|---|---|
| 1,892,945 | 1/1933 | Griebat | 301/44 B |
| 3,013,620 | 12/1961 | Hill | 37/142 R X |
| 3,099,191 | 7/1963 | Averette | 404/121 |
| 3,274,908 | 9/1966 | Grant et al. | 404/121 |
| 3,508,352 | 4/1970 | Radwill | 37/142 R |
| 3,598,028 | 8/1971 | Grant et al. | 404/121 |
| 3,891,341 | 6/1975 | Trainor et al. | 404/121 |

*Primary Examiner*—James A. Leppink
*Assistant Examiner*—John F. Letchford

[57] ABSTRACT

An off-the-road landfill compactor has large wheels with two piece cutting cleats the inner portion of which are attached to the outer surface of the wheels. The outer, replaceable portion of the cleat is secured to the inner portion by bolts which are directed toward each other but at an incline toward the center of the wheel so that tightening the bolts wedges the outer cleat portion into tighter contact with the inner portion. The bolts engage fastening means retained in recesses provided in the inner portion of the cleat.

9 Claims, 5 Drawing Figures

TWO BOLT TAPER CLEAT

BACKGROUND OF THE INVENTION

Compaction machines are used at landfill sites to crush and compact waste material deposited at such locations. These self propelled machines usually have three or four large driving wheels with inverted V shaped cleats mounted on their rims, the cleats being staggered around the periphery of the rims, generally with the axes of the cleats parallel to the axles of the wheels. As the wheels are rotated during the traverse of the machine over a path in the landfill, the cleats crunch into the material being compacted and unless encountering some solid substance, the crests of the cleats sink into the bed until the rims are supported thereby. Repeated passes crush and devoid the waste material increasing the density and aiding in its ultimate deterioration.

Considerable effort has been expended in developing the contour and construction of cleats to make them more effective in the crushing compaction of waste. Because of the abrasiveness of some of the materials dumped on the landfill, and the nature of the service, cleats tend to wear out rapidly requiring their replacement if the compactor is to retain its efficiency. A design of cleat invented by my coworker, Maurice J. Trainer and myself, and disclosed in U.S. Pat. No. 3,891,341 issued June 24, 1975, has been found to provide increased wear life, at least over many other forms of cleat used for this purpose. According to this patent, the radially outward corners of the converging faces of the cleat are enlarged, so that the outer cutting edge presents a "dog-bone" shape, which minimizes wear which would otherwise occur on the ends of this working face. The crests of cleats of this construction are parallel to the axle of the wheel and are usually welded to the rim and arranged in diagonal rows. When replacement is required, the welds are burned off and new cleats are welded in the same positions.

It has also been the practice to make the cleats in two pieces with the inner portion or base welded to the wheel and the outer, wearing portion connected to the base either by bolts or welding. These removable cleats have been used extensively on so-called "sheeps foot" rollers, used to compact surfaces such as road beds prior to paving. An example of one of this replaceable type of feet is disclosed in U.S. Pat. No. 3,274,908 issued Sept. 27, 1966. Here the replacable or cover element is held by a pin or bolt extending through the base; this pin in turn is held against endwise movement by a detent pressing against the central portion of the pin. The advantage of course in such a cleat is that the wear portion can be more easily removed and replaced than a solid cleat which is welded to the rim. Considering the large number of cleats (upwards of one hundred) that require replacement, on one wheel alone, the saving in time, using a two piece construction, is very considerable.

SUMMARY OF THE INVENTION

Instead of using a single bolt to fasten the replaceable wear member cleat to the base portion mounted on the rim, the cleat of this invention is fastened by a pair of bolts which extend inwardly toward each other and incline inwardly toward the rim. The inner ends of the bolts are anchored in the base member. Since they incline inwardly, tightening these bolts tightens the cleat on the base with mating wedge faces on the members providing extended surfaces of contact. Countersinking the outer ends of the bolt holes enables the bolts to be easily tightened and/or removed by a suitable socket wrench, while the other, inner ends of the bolts can be engaged by nuts retained in slotted cavities in the base, said cavities preventing the nuts from turning during tightening of the bolts. Utilization of this construction enables the outer replaceable member to have the same desirable contour as that shown in U.S. Pat. No. 3,891,341. The base member can be welded to the rim, preferably on all four sides, and the outer wear member can be formed so as to fit snugly over the tapered portions of the base.

DESCRIPTION OF THE PREFERRED EMBODIMENT

Figure 1:
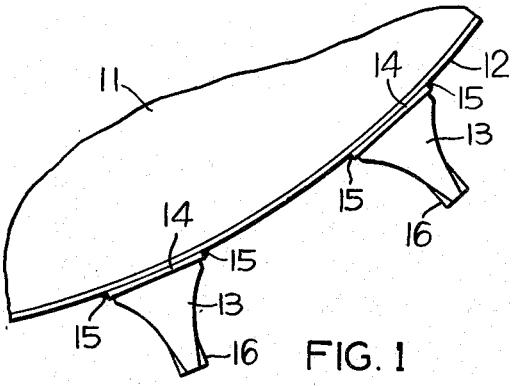
FIG. 1 is a side elevation of a portion of the rim of a compaction wheel showing several cleats mounted on the periphery of the wheel.

Referring to the drawings, FIG. 1 depicts a small portion of a compaction wheel 11, which is viewed from the end. Secured to the rim 12 are a plurality of V shaped cleats 13, each of which has a base portion 14 the outer marginal edges of which are welded to the rim as at 15. Actually all four edges of the base are welded to the rim and the bottom faces 14 are slightly concave to provide a fit with the curvature of the rim. The outer ends of the cutting edge of the cleats are slightly bulbous as at 16 to increase the wear resistance of the cleats. The advantages of this "dog-bone" shaped edge is explained in U.S. Pat. No. 3,891,341.

Figure 2:
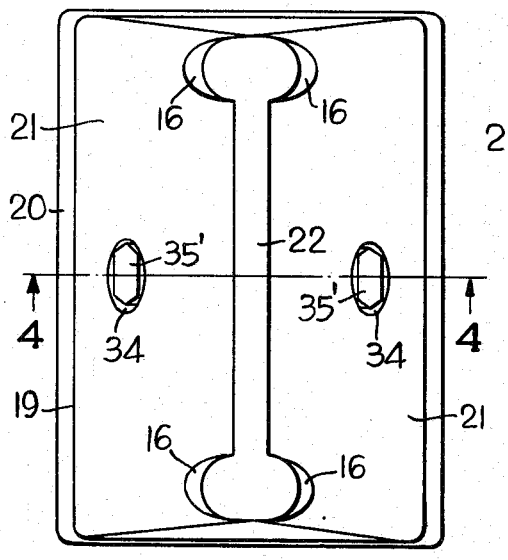
FIG. 2 is a plan view of an assembled compaction cleat.

Actually only the end portions 16 of the cutting face 22 of the cleats are enlarged, as shown in FIG. 2. When viewed from the top, the top edge presents the "dog-bone" shape previously described. In this view, the replaceable outer member 19 of the cleat covers all but the extreme outer margin of the platform portion 26 of the inner base member 25 of the cleat. It is the outer edges of the extended portion 20 which are welded to the rim 12.

Figure 4:
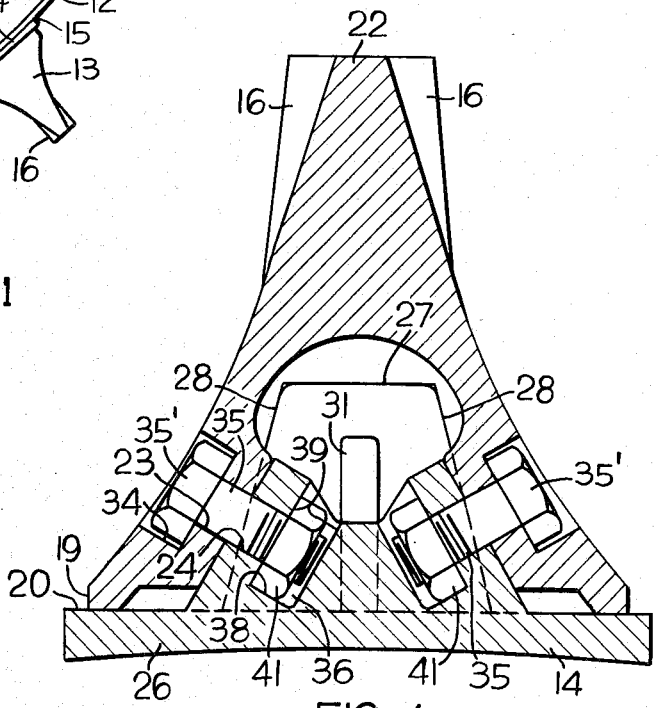
FIG. 4 is a section of the assembled cleat sections taken on line 4—4 of FIG. 2.

The side faces 21 of the outer portion 19 of the cleat, which converge at the cutting face 22, are each apertured at 23 by cylindrical bores whose axes are inclined inwardly toward the rim of the wheel. These apertures are aligned with cylindrical apertures 24 extending through the inner base member 25 as illustrated in FIG. 4. As shown in FIG. 4, the aligned axes of the holes 23 and 24 are at an angle of approximately 30° to the plane of the platform portion 26, said plane being approximately tangent to the rim of the wheel where the axes intersect this plane.

Figure 3:
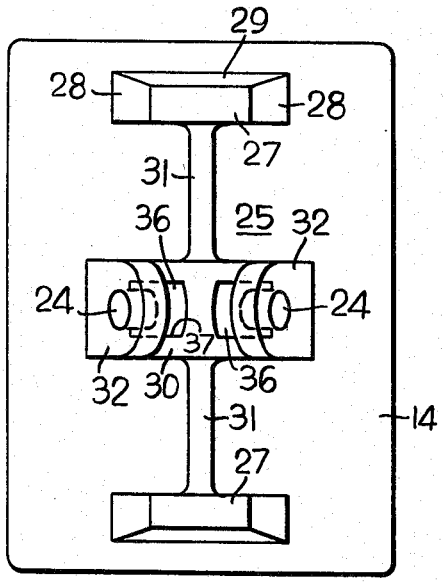
FIG. 3 is a plan view of the base section of the cleat.
Figure 5:
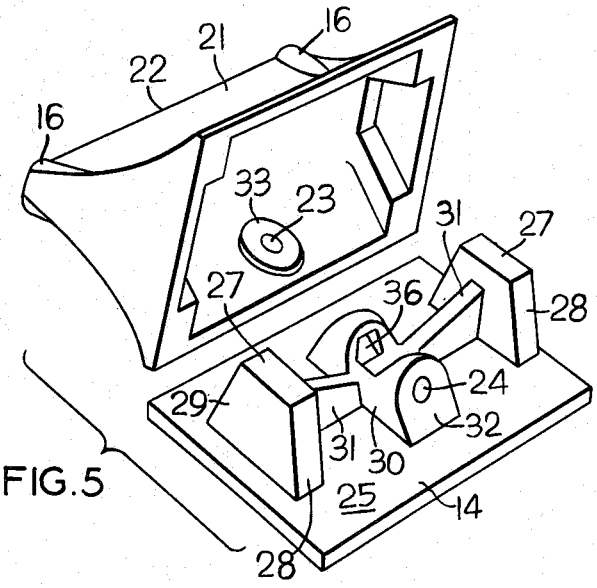
FIG. 5 is a disassembled perspective view of the base, wear portion of the cleat and the fastening devices illustrated in the other drawings.

The inner base member 25, best shown separately in FIG. 3, consists of platform 26 which conforms to the curvature of the rim and extends slightly beyond the outer bottom dimensions of the outer member 19. It is the outer edges of this platform portion which are welded to the rim of the wheel as at 15.

Mounted on the platform portion of the inner member 25 are two upstanding, spaced apart supports 27, each of which has side faces 28 and outer end faces 29 against which mating faces on the inside of the outer portion of the cleat are disposed to bear when the outer portion is fitted over the inner portion. The side faces 28 and the end faces 29 are tapered with the outer ends narrower as shown in FIG. 3. The mating tapered surfaces on the inside of the outer members enables the two members to be more firmly clamped together.

Disposed between these two outer supports is a central anchoring section or boss 30 extending upward from the platform 26 and connected to the outer supports 27 by the reinforcing struts 31. Extending through spaced portions of the boss 30 are bores 24 of the same diameter as the bores 23 in the outer member of the cleats. The axes of these two bored sections are aligned with the axes of the bores in the outer portion of the cleat so that they can be connected by bolts. The side faces 32 of the central support 30 converge upwardly at right angles to the bore and form an angle to the platform portion 26 which corresponds to the angle formed by the inner face of the side sections of the outer member 19.

Thus, when the outer member 19 is placed over the inner member 25, the flat inner sides of the end portions of the outer member fit snugly over the tapered ends 29 of the inner section, the flat inner faces of the hollow outer portions of the side faces of the outer sections lie face to face with the faces 28 of the base 25 while the flat inner side faces 33 of the central portions of the outer member 19 abut the faces 32 of the boss or support member 25. While the face 32 makes an angle of approximately 60° to the platform portion 26, the faces 28 and 29 are slightly steeper, ie, in excess of 60° to the base, thus facilitating the alignment of the members.

As shown in FIG. 4, the apertured bored portion 35 in the outer member are counter bored on their outer ends as at 34, so that bolts 35 may be inserted therein with the bolt heads 35' recessed in the counter bores, sufficient clearance being provided so that a socket wrench may be inserted in the counter bore to tighten and/or unscrew the bolts from their retaining means. It should also be noted that the counter bores fill with dirt and debris, thus protecting the bolt heads from wear. Such debris also acts as a locking means to prevent the bolt from loosening.

Various retaining means may be employed to retain the bolts in the supporting section of the base. As here shown two open-topped recesses 36 are provided in the section 30, each having parallel sides 37 and a closed bottom 38 arranged to closely confine the sides and support the bottom of a hexagonal nut 41 which can be dropped in the recess with its threaded hole aligned with the holes 23 and 24 extending through the respective members 19 and 25. Thus when the bolts are threaded into the nuts, the latter are held against turning by the sides of the recess in which they are located. The end walls 39 of the recesses also confine the nuts against end movement with the nuts at right angles to the bolts so that the bolts can be threaded into the nuts even when the outer cleat member completely encloses the inner member.

Since the bolts 35 are aligned with each other but have their axes inclined or pointing downward toward the rim, tightening these bolts draws the outer portion 19 of the cleat into tight engagement with the inner section 25, thus eliminating relative motion and resulting wear. Not only is the outer section well anchored on the inner section but the lower edges of the outer section can be closely fitted against the platform section 26 of the inner member. This prevents material from getting between the members and prying them apart.

Various modifications of the preferred embodiment of the invention may be made. For instance, the apertures 24 in the inner cleat member 25 could be threaded for engagement with the bolts 35, but the use of the retained nuts 41 has the advantage of eliminating any machining operation.

When the outer members 19 become worn, they can be easily replaced by unscrewing and removing the bolts 35, prying them loose, and then substituting a new outer member. Replacement can be quickly accomplished and the nuts will be retained in the recesses in the base members provided the cleats being replaced are on the upper portion of the rim so they cannot fall out.

The invention having been described, what is claimed is:

1. A two piece cleat for the working face of the wheel of a compaction machine, said cleat comprising an inner base member securely fastened to the wheel and a replaceable outer wear member arranged to enclose the base member and means securing the two members together comprising a pair of opposed, inwardly inclined fasteners each engaging the outer member and so secured to the inner member that tightening the fasteners draws the outer member into close engagement with the inner base member, thus eliminating relative motion and resulting wear.

2. Apparatus according to claim 1 in which the base member has inwardly converging surfaces on both its side and end portions and the outer member has mating inward converging surfaces, said mating surfaces being disposed face to face with each other when the members are fastened together.

3. Apparatus according to claim 2 in which the fastening means comprise bolts extending through aligned bores in the two members and means retaining the inner ends of the bolts, the axes of said bores inclined inwardly at an appropriate angle to a plane tangent to the surface of the wheel to cause the outer and inner members to be wedged together.

4. In a compaction wheel for a land fill compactor or the like, a two pieced cleat comprising a base member permanently secured to the rim of the wheel, said base having a central boss, and a pair of spaced inwardly inclined apertures extending upwardly and outwardly through portions of the boss towards the sides of the base, a replaceable cover member having a contour designed to compress and cut the surface of the land fill, said cover member having apertures axially aligned with those in the base, bolts extending through the apertures inwardly and toward each other and slotted recesses in the central boss arranged to retain without turning or axial movement a pair of aligned nuts one of which is engageable with each of said bolts.

5. Apparatus according to claim 4 in which the cover member has flat raised portions surrounding the inner ends of the apertures extending therethrough and the base member has faces mating with said flat raised portions to enable said members to be firmly clamped together.

6. A two piece cleat for a compaction wheel comprising an inner base member having a platform portion fitting on the surface of the wheel, spaced supports extending outward from the platform portion, said supports providing inwardly converging flat faces, an outer wear member arranged to enclose said inner member with flat inner faces arranged to mate with said inwardly converging flat faces of the inner member and means at an angle normal to said flat inner faces extending through said outer wear member in a position between said spaced supports and engageable with said inner member to clamp said members together.

7. Apparatus according to claim 6 in which the two spaced supports have inwardly converging end faces and the outer member has mating faces preventing end movement of the two members relative to each other.

8. A replaceable wear cleat member for a compaction roller having a cylindrical rim and a base member secured to the rim, said wear cleat member having a hollow inner portion with two side portions arranged to cover the base member, the lower ends of the side portions lying in a plane tangent to the surface of the rim to which the base member is attached, the opposed side portions of the wear member having cylindrical apertures, the axes of which lie at an angle to the aforesaid plane with the inner ends of such apertures being closer to the rim than the outer ends whereby the wear member may be mounted on the base member and retained by bolts extending inwardly through such apertures and engageable with retaining means provided by the base member.

9. Apparatus according to claim 8 in which the sides of the wear member through which the apertures extend converge toward each other and form a crest for cutting and crunching material being compacted.

* * * * *